US006356179B1

(12) United States Patent
Yamada

(10) Patent No.: US 6,356,179 B1
(45) Date of Patent: Mar. 12, 2002

(54) INDUCTANCE DEVICE

(75) Inventor: Satoru Yamada, Tokyo (JP)

(73) Assignees: Sumida Technologies Incorporated; Sumida Corporation, both of Tokyo (JP)

( * ) Notice: Subject to any disclaimer, the term of this patent is extended or adjusted under 35 U.S.C. 154(b) by 0 days.

(21) Appl. No.: 09/506,376

(22) Filed: Feb. 18, 2000

(30) Foreign Application Priority Data

Jun. 3, 1999 (JP) ..... 11-192169
Sep. 22, 1999 (JP) ..... 11-268216

(51) Int. Cl.[7] ..... H01F 17/06
(52) U.S. Cl. ..... 336/175; 336/178; 336/92
(58) Field of Search ..... 336/175, 178, 336/92, 212

(56) References Cited

U.S. PATENT DOCUMENTS 5,321,373 A * 6/1994 Shusterman et al. ..... 333/12
5,783,978 A * 7/1998 Noguchi et al. ..... 333/202
5,844,462 A * 12/1998 Rapoport et al. ..... 336/212
6,144,279 A * 11/2000 Collins et al. ..... 336/178

FOREIGN PATENT DOCUMENTS

JP 2228008 A * 9/1990

* cited by examiner

*Primary Examiner*—Anh Mai
(74) *Attorney, Agent, or Firm*—Finnegan, Henderson, Farabow, Garrett & Dunner, L.L.P.

(57) ABSTRACT

An inductance device according to the present invention, which is for use in power supply units, is constructed in such a manner that a slit 3 is provided in one side of a polygonal cylindrical ferrite core 1 in the same direction to a hollow portion 2 to form an open magnetic path, and a belt-like conductor 4 is inserted through the hollow portion 2, so as to minimize the dimensions, have an inductance value not more than 1 $\mu$H, and hold DC overlapping characteristic flat even if high current flows.

5 Claims, 8 Drawing Sheets

FIG.6

| PARAMETERS / SAMPLES | D | W | H | ta | tb | g | g·tb·D |
|---|---|---|---|---|---|---|---|
| L7H-G08 | 7.5 | 4.8 | 2.7 | 1.15 | 1.15 | 0.08 | 0.690 |
| L7H-G10 | 7.5 | 4.8 | 2.7 | 1.15 | 1.15 | 0.10 | 0.825 |
| L7H-G12 | 7.5 | 4.8 | 2.7 | 1.15 | 1.15 | 0.12 | 1.035 |

$\mu = 800$

INDUCTANCE DEVICE

TECHNICAL FIELD

This invention relates to an inductance element, for example, for use in power supply units of computers.

BACKGROUND ART

FIG. 8 shows an example of a circuit of a step-down type DC/DC converter for use in the power supply unit of computers. Reference numeral 101 denotes a control IC, reference symbol VB denotes a source of voltage supply, reference numeral 102 denotes a switching circuit, reference numeral 103 denotes a load for CPU or others, and reference numeral 106 denotes a capacitor.

The switching circuit 102 consists of switching devices 105*a*, 105*b* connected to output terminals S, T for driving of the control IC 101, and an inductance device 104 connected between an output terminal U of the switching devices 105*a*, 105*b* and the load 103.

In the above construction, load current from several amperes to dozens of amperes flows through the load 103 connected between an output side of the inductance device 104 and earth, and at the same time high current flows through the inductance device 104. The inductance value of the inductance device 104 is varied in response to variation in load and switching operation of the switching circuit 102. Therefore, when the inductance value of the inductance device 104 is varied, the operation of the switching circuit 102 becomes unstable. By the way, in a conventional manner, because operating (switching) frequency of the control IC 101 and the switching devices 105*a*, 105*b* used for the above circuit is not so high, as the inductance device 104 used for the switching circuit 102, one whose inductance value is about dozens of $\mu$H (micro henries) has been used. Moreover, as the construction of the inductance device 104 above, for example, wide-core wire is merely wound around a wide-core drum-shaped ferrite core at a predetermined number of times.

In recent years, along with the advance of technology, the operating frequency of the control IC 101 and the switching devices 105*a*, 105*b* above becomes quite high, as the inductance device used for the DC/DC converter circuit above, one whose inductance value is not more than 1 $\mu$H has been required.

Furthermore, together with the control IC 101 and the switching devices 105*a*, 105*b*, the performance of CPU has been improved to speed up. If said CPU is applied as the load of the DC/DC converter circuit, the CPU will be very heavy load therefor (the load current will be very high). However, the inductance device of construction in which wire is wound around the conventional drum-shaped ferrite core is difficult to make the inductance value thereof minute value of not more than 1 $\mu$H, cannot provide stable inductance value when high current about dozens of amperes flows, and also is in the difficult state to be minimized in the dimensions.

The present invention is made to meet the requests for the inductance device above, and an object thereof is to provide an inductance device whose dimensions can be minimized, which has an inductance value of not more than 1 $\mu$H, and whose DC characteristic is almost flat even if high current flows.

SUMMARY OF THE INVENTION

In order to achieve the above object, an inductance device according to the present invention for use in power supply units is characterized in that a slit is provided on one surface of a polygonal cylindrical ferrite core in the same direction to the depth direction of a tube hole, and a conductor is inserted through the tube hole. Besides, the inductance device is further characterized in that the conductor is wound to pass through into said tube hole two or more times. Moreover, the inductance device is characterized in that the conductor is a plate one.

Besides, the inductance device according to the present invention for use in power supply units is characterized in that the ferrite core is shaped into square cylindric, a slit is provided in one side of the ferrite core in the same direction to a hollow portion to form an open magnetic path, and a belt-like conductor is inserted through the hollow portion. Moreover, the inductance device is characterized in that each end of the belt-like conductor inserted through the hollow portion of the square cylindrical ferrite core is formed into a surface mount terminal.

BRIEF DESCRIPTION OF THE DRAWINGS

FIG.6 is a diagram showing values of length parameters of each inductance device sample according to embodiments of the present invention.

DETAILED DESCRIPTION OF THE INVENTION

First Embodiment

Figure 1:
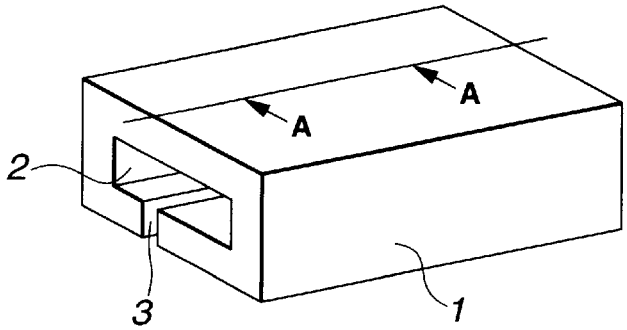
FIG. 1 is a perspective view of a ferrite core of an inductance device according to the present invention.
Figure 2:
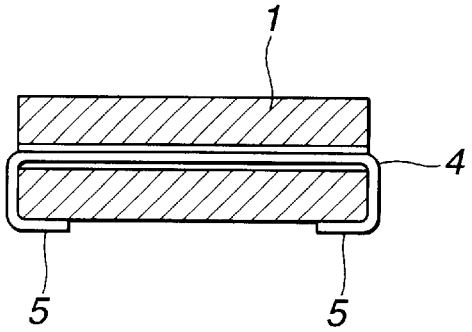
FIG. 2 is a sectional view taken along A—A line of the inductance device using the ferrite core shown in FIG. 1.
Figure 3:
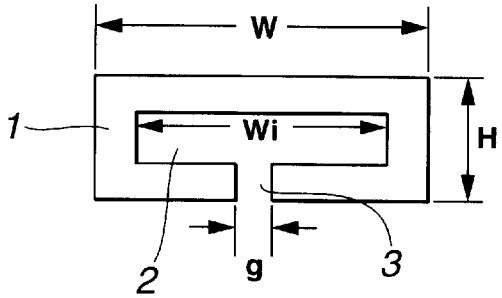
FIG. 3 is a side view of the ferrite core shown in FIG. 1.

Referring to the accompanying drawings, hereinafter embodiments of the present invention will be explained. In each drawing, same constitutive devices are given same symbols without repeated explanations. In FIGS. 1 to 3, illustrations of the inductance device according to the first embodiment are shown. FIG. 1 shows a perspective view only of the ferrite core 1, FIG. 2 shows a sectional view taken along A—A line in condition of assembling with the belt-like conductor inserted through the hollow portion 2 of the ferrite core 1 shown in FIGS. 1 and 3 shows a front view only of the ferrite core 1.

In the above, the polygonal cylindrical ferrite core 1 has the hollow portion 2. At one side of the ferrite core 1, a slit 3 is formed in the same direction to said hollow portion 2. Besides, although the position where said slit 3 is formed is allowed to be formed in every side of the ferrite core 1 if it is in the same direction with respect to the hollow portion 2. In this embodiment, in order to reduce leakage flux, it is shaped in the surface to become a bottom face in assembled condition. The belt-like conductor 4 is inserted through said hollow portion 2. Each end thereof, for example, is bent to the bottom side of the ferrite core 1 to be formed into a surface mount terminal 5. The inductance device according to this embodiment is formed into the surface mount component by this surface mount terminal 5. The width of the belt-like conductor 4 is made almost same as the width Wi of the hollow portion 2 shown in FIG. 3.

Figure 7:
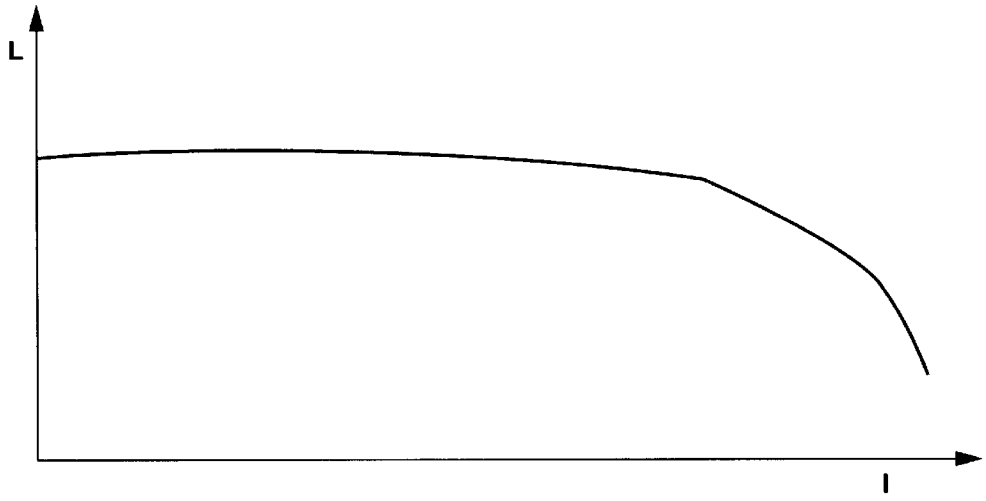
FIG.7 is a graph showing DC characteristics of inductance devices according to embodiments of the present invention.
Figure 8:
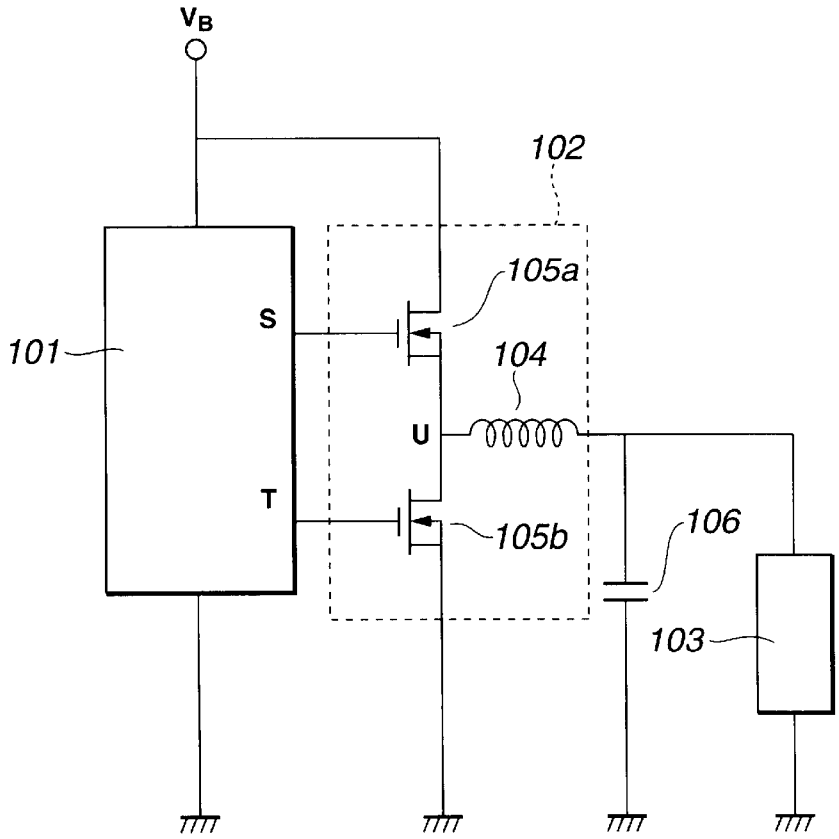
FIG. 8 is a circuit diagram of a power supply unit of a computer applied an inductance device according to an embodiment of the present invention.

Therefore, the inductance device according to this embodiment is adopted to the inductance device 104 used for the power supply unit as shown in FIG. 8, where the inductance device has a construction being made the slit 3 in the same direction to the depth direction of the hollow portion 2 being a tube hole in one surface of the polygonal cylindrical ferrite core 1, and being inserted a conductor (the belt-like a conductor 4 herein) through the hollow portion 2 being the tube hole. Because the inductance device according to this embodiment is provided with the slit 3 in the same direction to the hollow portion 2 of the ferrite core 1 to form an open magnetic path, it is possible to prevent magnetic saturation from occurring, DC overlapping characteristic thereof can be made as shown FIG. 7, and it is possible to provide almost constant inductance value L in a high level range of DC current I. In addition, to provide the slit 3, it is possible to decrease variation of the inductance value of produced individual inductance devices.

Figure 4:
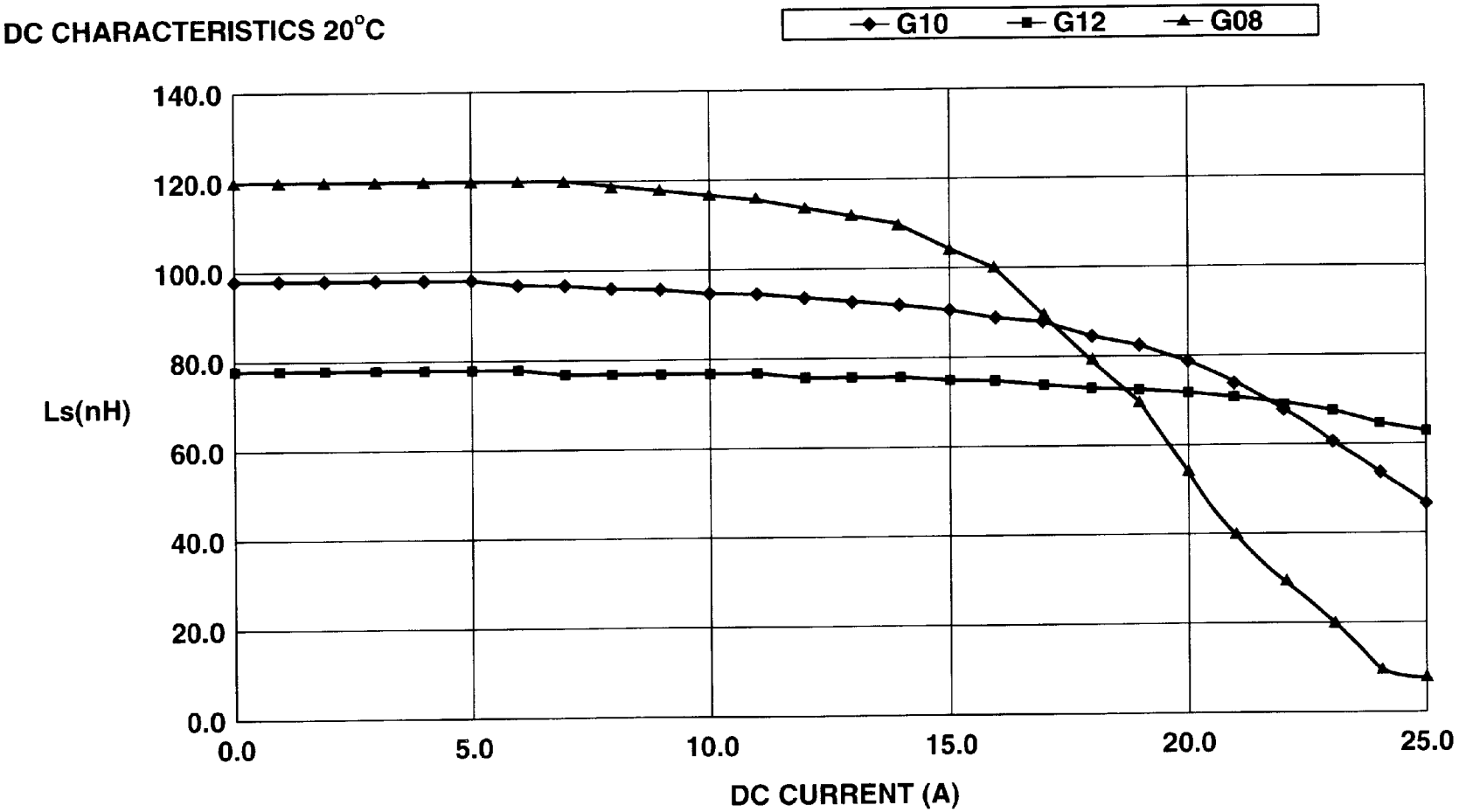
FIG. 4 is a graph showing DC characteristics of inductance devices according to embodiments of the present invention.
Figure 5:
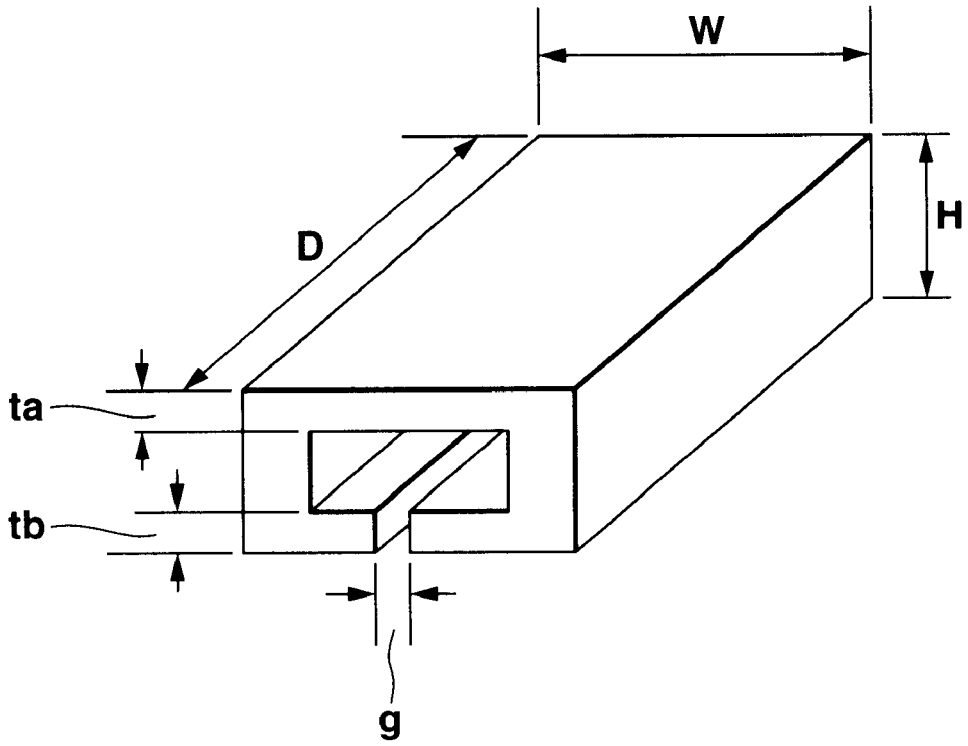
FIG. 5 is a diagram showing locations of length parameters of an inductance device according to embodiments of the present invention.

More concretely measured results of variation of the inductance value L to the DC current I in the inductance device above are shown in FIG. 4. As for samples of L7H-G08, L7H-G10, and L7H-G12 used for this measurement, the positional relationship of parameters of each length thereof is shown in FIG. 5, and the values of parameters of the respective lengths are shown in FIG. 6. Here, the "$\mu$" is permeability.

The samples of L7H-G08, L7H-G10, and L7H-G12 used for this measurement, are made widths of gaps g in FIG. 5 0.08 mm, 0.1 mm, and 0.12 mm respectively. In any sample, it is possible to have a minute inductance value about not more than 1 $\mu$H (in this embodiment, 80–120 nH (nano henries)) as clearly shown in FIG. 4, and have a flat characteristic of the inductance value L at DC current of about 15–25 amperes (the characteristic is that the inductance value L drops about 20 percent from initial condition), so that it is possible to ensure stable circuit operation.

Second Embodiment

Figure 9:
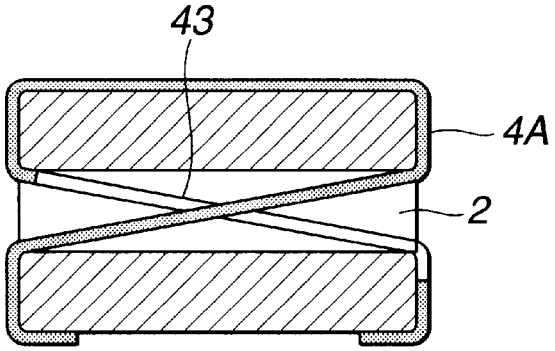
FIG. 9 is a sectional view of an inductance device according to the second embodiment of the present invention.
Figure 10:
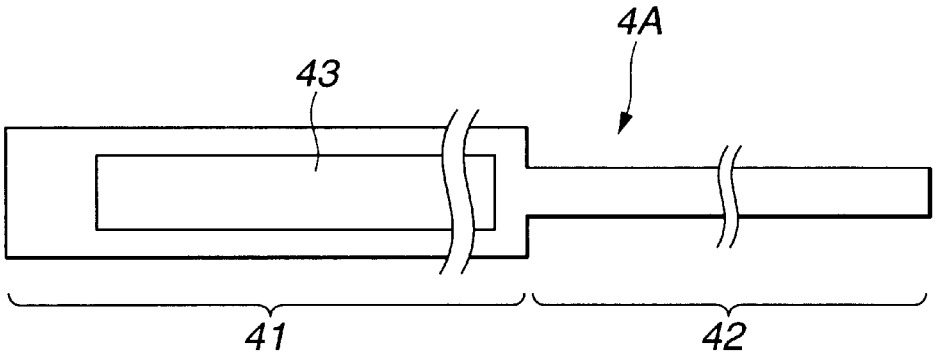
FIG. 10 is a plan view of a conductor used for an inductance device according to a second embodiment of the present invention.

Next, referring to FIGS. 9–11 the inductance device according to the second embodiment will be described. As in FIG. 9 the sectional view of a belt-like conductor 4A shown in FIG. 10 is shown, this inductance device is made to pass the belt-like conductor 4A through the hollow portion 2 two or more times (two times) to add the number of turns, so as to increase the inductance value.

The belt-like conductor 4A has a wide width portion 41 whose width is almost equal to the breadth of the hollow portion 2, and a narrow width portion 42 which is shaped to have a narrower width than the wide width portion 41. A hole portion 43 is formed in the wide width portion 41 so as that the narrow width portion 42 can pass therethrough in the hollow portion 2. The wide width portion 41 of the belt-like conductor 4A is pulled out from the bottom face near the opening portion of the hollow portion 2, set so as to locate the hole portion 43 in the hollow portion 2. The belt-like conductor 4A is upwardly bent from the opening portion at the other end of the hollow portion 2, and is placed from the opening portion over surface portion into the hollow portion 2 again. The area of the belt-like conductor 4A where the belt-like conductor 4A is placed from the opening portion over surface portion into the hollow portion 2 again is the narrow portion 42, which passes through the hole portion 43 and is downwardly bent from the opening portion at the other end of the hollow portion 2, then fixed at the bottom face near the opening portion.

Figure 11:
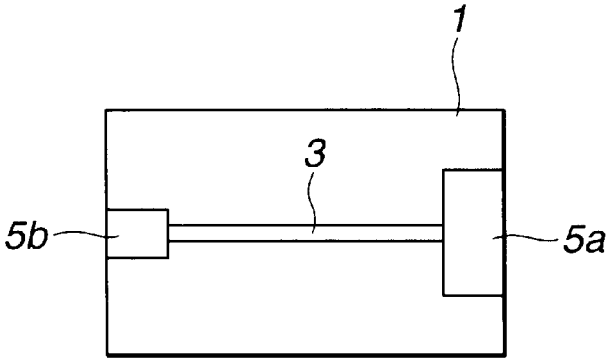
FIG. 11 is a bottom view of an inductance device according to the second embodiment of the present invention.

By the above construction, the surface mount terminal 5*a* according to the end of the wide width portion 41 and the surface mount terminal 5*b* according to the end of the narrow width portion 42 are fixed at the bottom face of the inductance device as shown in FIG. 11. The inductance device according to this embodiment becomes a surface mount component by providing these surface mount terminals 5*a*, 5*b*. In accordance with this construction, the inductance value is higher than that in the first embodiment, it is possible to prevent magnetic saturation from occurring similarly to the first embodiment, and DC characteristic thereof shows almost constant inductance value L in a high level range of DC current I. Moreover, it is possible to decrease variation of the inductance value of produced individual inductance devices Third Embodiment Next, referring to FIGS. 12–15 the inductance device according to the third embodiment will be described. In this inductance element, the belt-like conductor 4 is wound around the ferrite core 1 as shown in FIG. 15. That is to say, an end of the belt-like conductor 4 is fixed at the bottom face near the opening portion of the hollow portion 2, and another end portion of said belt-like conductor 4 is placed into the hollow portion 2, is upwardly bent from the opening portion at another end of the hollow portion 2, and is placed from the opening portion over the surface portion into the hollow portion 2 again. The belt-like conductor 4 placed from the opening portion over the surface portion into the hollow portion 2 again passes through the hollow portion 2 and is upwardly bent from the opening portion at the other end of the hollow portion 2 again, and is placed from the opening portion over the surface portion into the hollow portion 2 thrice. The belt-like conductor 4 placed from the opening portion over the surface portion into the hollow portion 2 passes through the hollow portion 2 and reaches the opening portion at the other end of the hollow portion 2. Then, the conductor is downwardly bent and fixed at the bottom face near the opening portion.

Figure 12:
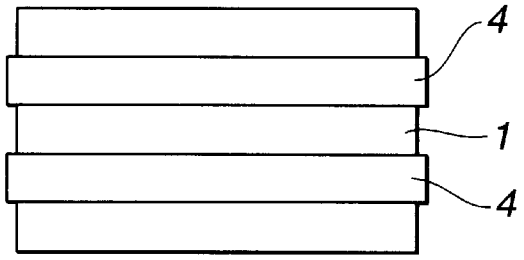
FIG. 12 is a plan view of an inductance device according to a third embodiment of the present invention.
Figure 13:
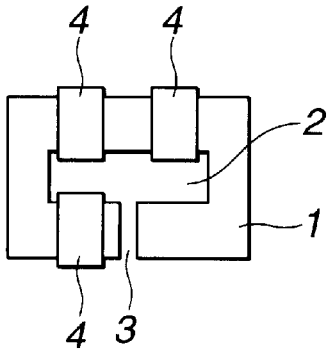
FIG.13 is a side view of an inductance device according to the third embodiment of the present invention.
Figure 14:
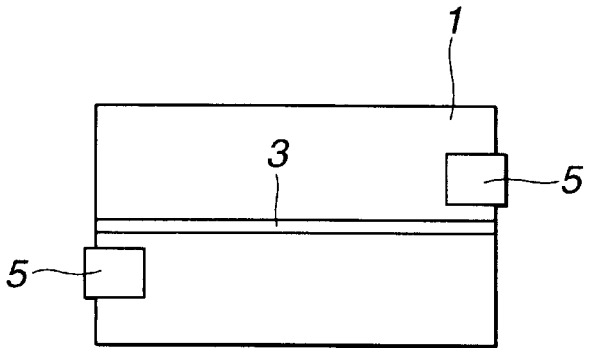
FIG. 14 is a bottom view of an inductance device according to the third embodiment of the present invention.
Figure 15:
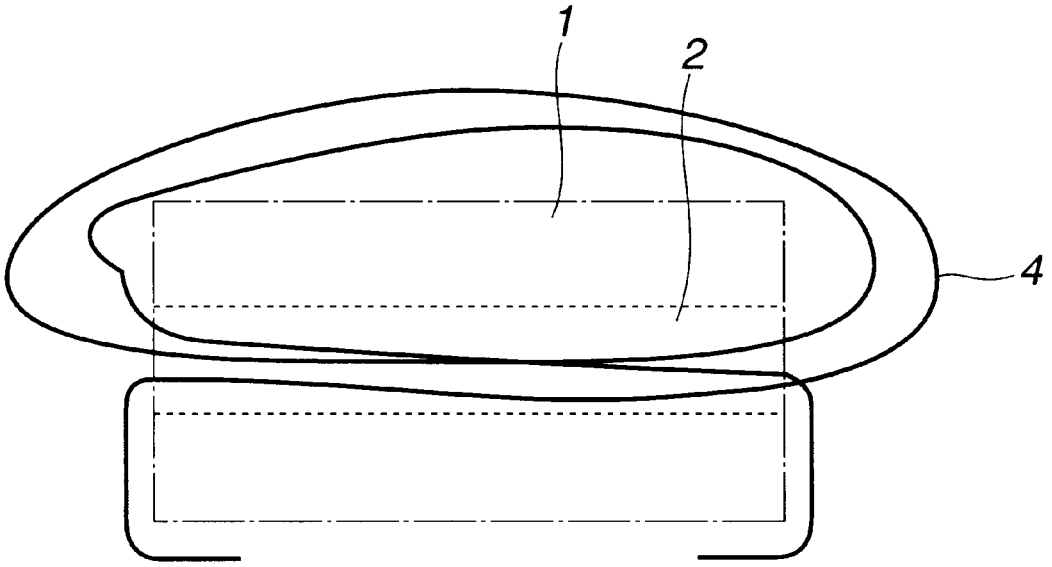
FIG. 15 is an illustration of winding wire of an inductance device according to the third embodiment of the present invention.

As a result, it will be obvious in FIG. 12 being a plan view and FIG. 13 being a side view, the belt-like conductor 4 in two lines is set on the top surface, and it is obvious in FIG. 14 being a bottom view and FIG. 13 being a side view, the surface mount terminals 5 according to the end of the belt-like conductor 4 are fixed at each bottom face divided by the slit 3. The inductance device according to this embodiment becomes a surface mount component by providing these surface mount terminals 5.

As it is obvious from FIG. 15 showing only the condition for winding the belt-like conductor 4, this inductance device is made by passing the belt-like conductor 4 through the hollow portion 2 two or more times (three times) to add the number of turns so as to increase the inductance value. In accordance with this construction, the inductance value is higher than that in the second embodiment, and it is possible to prevent magnetic saturation from occurring similarly to the first embodiment, DC overlapping characteristic thereof shows almost constant inductance value L in a high level range of DC current I. Moreover, it is possible to decrease variation of the inductance value of produced individual inductance devices As described above, in each embodiment of the present invention a gap according to the slit 3 is provided and their constructions allow the inductance value to be designed minute value not more than 1 $\mu$H. Also high current is acceptable to flow, so they are suitable for the inductance device of the step down type DC/DC converter circuit using for the power supply unit of computers as shown in FIG. 8. In addition, it is easy to make as a surface mount component because the shape of the ferrite core is polygonal tube-like, and it is possible to be small for its mount space because the dimensions of the ferrite core can be decreased, resulting in contributing to become smaller in size and thinner in thickness when it is adopted for notebook style personal computers.

What is claimed is:

1. An inductance device for use in power supply units, said inductance device comprising:

a polygonal cylindrical ferrite core having a tube hole therethrough; said polygonal cylindrical ferrite core provided with a slit in one surface thereof in a same direction to a depth direction of the tube hole; and a conductor inserted through said tube hole of said polygonal cylindrical ferrite core.

2. An inductance device according to claim 1 wherein said conductor is wound to pass through into said tube hole two or more times.

3. An inductance device according to claim 1 or 2 wherein said conductor is a plate one.

4. An inductance device for use in power supply units, said inductance device comprising:

a polygonal cylindrical ferrite core having a hollow portion therethrough; said polygonal cylindrical ferrite core provided with a slit in one side thereof in a same direction to the hollow portion to form an open magnetic path; and a belt-like conductor inserted through said hollow portion of said polygonal cylindrical ferrite core.

5. An inductance device according to claim 4 wherein each end of said belt-like conductor inserted through the hollow portion of said ferrite core is formed into a surface mount terminal.

* * * * *